US012163399B1

(12) United States Patent
Ssafwany et al.

(10) Patent No.: US 12,163,399 B1
(45) Date of Patent: Dec. 10, 2024

(54) APPLYING INTERNAL COATINGS TO WELLBORE TUBULARS FOR WORKOVER OPERATIONS

(71) Applicant: Saudi Arabian Oil Company, Dhahran (SA)

(72) Inventors: Ali Radi Ssafwany, Safwa (SA); Ahmad Mubarak, Saihat (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/326,394

(22) Filed: May 31, 2023

(51) Int. Cl.
*E21B 33/13* (2006.01)
*E21B 47/007* (2012.01)

(52) U.S. Cl.
CPC ..... *E21B 33/13* (2013.01); *E21B 47/007* (2020.05)

(58) Field of Classification Search
None
See application file for complete search history.

(56) References Cited

U.S. PATENT DOCUMENTS

| | | | | |
|---|---|---|---|---|
| 4,146,060 | A * | 3/1979 | Garrett | B29C 66/53241 138/146 |
| 4,800,104 | A * | 1/1989 | Cruickshank | F16L 58/02 118/503 |
| 8,261,841 | B2 | 9/2012 | Bailey et al. | |
| 8,286,715 | B2 | 10/2012 | Bailey et al. | |
| 8,574,667 | B2 | 11/2013 | John et al. | |
| 8,602,113 | B2 | 12/2013 | Jin et al. | |
| 10,316,628 | B2 | 6/2019 | Kriesels et al. | |
| 2006/0151179 | A1* | 7/2006 | Boyadjieff | E21B 41/0085 166/380 |
| 2014/0356533 | A1* | 12/2014 | Harmat | E21B 43/08 427/244 |

* cited by examiner

*Primary Examiner* — Andrew Sue-Ako
(74) *Attorney, Agent, or Firm* — Fish & Richardson P.C.

(57) ABSTRACT

A wellbore workover tool assembly to apply internal coatings to wellbore tubulars for workover operations includes a coating sub-assembly, a composition and a wellbore conveyance. The coating sub-assembly can be lowered through a wellbore tubular installed within a wellbore. The composition can be carried by the coating sub-assembly. The coating sub-assembly can coat the composition on an inner wall of the wellbore tubular. The composition can be configured to increase a mechanical strength of the wellbore tubular. The wellbore conveyance can be operatively coupled to the coating sub-assembly carrying the composition. The wellbore conveyance can lower and raise the coating sub-assembly through the wellbore as the coating sub-assembly coats the composition on the inner wall of the wellbore tubular.

10 Claims, 4 Drawing Sheets

APPLYING INTERNAL COATINGS TO WELLBORE TUBULARS FOR WORKOVER OPERATIONS

TECHNICAL FIELD

This disclosure relates to wellbore operations, and particularly to wellbore workover operations which are performed to repair wellbores or enhance production through wellbores or both.

BACKGROUND

Wellbore tubulars include, for example, production tubing, casing or other tubulars installed within wellbores and through which well fluids flow. Well fluids can include hydrocarbons (e.g., petroleum, natural gas, combinations of them) or other fluids (e.g., water, drilling mud). Some well fluids are corrosive in nature. Prolonged exposure to such fluids can damage wellbore tubulars. For example, the material of the wellbore tubulars can degrade causing the tubulars to lose mechanical strength (e.g., tensile or compressive strength when pulled or pushed longitudinally within the wellbore). A wellbore tubular, which has been installed in a wellbore and which has experienced degradation beyond an accepted level, may need to be retrieved from the wellbore. Workover operations may need to be performed for such retrieval. However, the degradation of the wellbore may render such retrieval difficult, for example, because the wellbore may break during such retrieval. Addressing tubular degradation is one of several reasons to perform workover operations. Other reasons include, for example, packer failure. In another example, reservoir management decisions can require workover and decompletion of a well by retrieving the existing production tubing.

SUMMARY

This specification describes technologies relating to applying internal coatings to wellbore tubulars for workover operations.

Certain aspects of the subject matter described here can be implemented as a wellbore workover tool assembly. The assembly includes a coating sub-assembly, a composition and a wellbore conveyance. The coating sub-assembly can be lowered through a wellbore tubular installed within a wellbore. The composition can be carried by the coating sub-assembly. The coating sub-assembly can coat the composition on an inner wall of the wellbore tubular. The composition can be configured to increase a mechanical strength of the wellbore tubular. The wellbore conveyance can be operatively coupled to the coating sub-assembly carrying the composition. The wellbore conveyance can lower and raise the coating sub-assembly through the wellbore as the coating sub-assembly coats the composition on the inner wall of the wellbore tubular.

An aspect combinable with any other aspect includes the following features. The composition includes an additive that can cure upon contact with the inner wall of the wellbore tubular. Upon curing, the additive increases the mechanical strength of the wellbore tubular.

An aspect combinable with any other aspect includes the following features. The additive includes an epoxy.

An aspect combinable with any other aspect includes the following features. Prior to coating, the additive is in a liquid state. After curing, the additive is configured to transition to a solid state.

An aspect combinable with any other aspect includes the following features. Prior to coating, the additive is in the solid state. In response to application of heat, the additive can transition from the solid state to the liquid state.

An aspect combinable with any other aspect includes the following features. The coating sub-assembly is a spray coating sub-assembly that can spray the composition on the inner wall of the wellbore tubular.

An aspect combinable with any other aspect includes the following features. The spray coating sub-assembly is a thermal spray coating sub-assembly that can heat and transition the composition from a solid state to a liquid state prior to spraying the composition on the inner wall of the wellbore tubular.

An aspect combinable with any other aspect includes the following features. The spray coating sub-assembly includes multiple nozzles that sprays the composition on the inner wall of the wellbore tubular.

An aspect combinable with any other aspect includes the following features. Each of the multiple nozzles is oriented radially with reference to a longitudinal axis of the wellbore tubular.

An aspect combinable with any other aspect includes the following features. The wellbore conveyance includes at least one of a coiled tubing, a drill pipe, a slick line or an electric cable.

Certain aspects of the subject matter described here can be implemented as a method. During a wellbore workover operation to remove a wellbore tubular installed within a wellbore, a coating sub-assembly is lowered through the wellbore tubular into the wellbore using a wellbore conveyance. Using the coating sub-assembly, a composition carried by the coating sub-assembly is coated on an inner wall of the wellbore. The composition is configured to increase a mechanical strength of the wellbore tubular. After coating the composition on the inner wall of the wellbore, the coating sub-assembly is raised through the wellbore tubular out of the wellbore.

An aspect combinable with any other aspect includes the following features. After coating the composition on the inner wall of the wellbore tubular, the wellbore tubular with the coated composition is removed from within the wellbore.

An aspect combinable with any other aspect includes the following features. The composition is configured to cure upon contact with the inner wall of the wellbore tubular. After coating the composition on the inner wall of the wellbore and before removing the wellbore tubular with the coated composition, a duration sufficient for the composition to cure on the inner wall of the wellbore tubular is allowed to pass.

An aspect combinable with any other aspect includes the following features. Prior to coating, the composition is in a liquid state. After curing, the composition transitions to a solid state. The duration that is allowed to expire is sufficient for the composition to transition from the liquid state to the solid state.

An aspect combinable with any other aspect includes the following features. The composition can be coated by spray coating.

An aspect combinable with any other aspect includes the following features. To spray coat the composition, the composition is flowed through multiple nozzles that spray the composition on the inner wall of the wellbore tubular.

An aspect combinable with any other aspect includes the following features. The multiple nozzles are oriented radially with reference to a longitudinal axis of the wellbore tubular.

Certain aspects of the subject matter described here can be implemented as a method. It is determined that a mechanical strength of a wellbore tubular installed within a wellbore is compromised along a longitudinal length segment of the wellbore tubular. In response to determining that the mechanical strength is compromised, a coating sub-assembly is lowered through the wellbore tubular into the wellbore using a wellbore conveyance. Using the coating sub-assembly, a composition carried by the coating sub-assembly is coated on an inner wall of the longitudinal length segment. The composition can increase a mechanical strength of the longitudinal length segment. After coating the composition on the inner wall of the wellbore, the coating sub-assembly is raised through the wellbore tubular out of the wellbore using the wellbore conveyance. A duration sufficient for the coated composition to cure on the longitudinal length segment of the wellbore tubular is allowed to pass.

An aspect combinable with any other aspect includes the following features. After the duration has expired, the wellbore tubular is removed from within the wellbore.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes a wellbore workover completion assembly that can be operated to coat an inner wall of a wellbore tubular that is installed within a wellbore. For example, the workover completion assembly can coat an inner wall of the wellbore tubular with a composition (e.g., an additive including epoxy or resin or a combination of the two), which can increase a mechanical strength of the coated portion of the wellbore tubular and the wellbore tubular as a whole. In general, the composition can be one that can tolerate downhole wet environment conditions and that can solidify quickly to create a coat on the inner wall of the wellbore. The coat combined with the wellbore tubular can have a greater mechanical strength compared to the wellbore tubular alone. After applying the coating and increasing the mechanical strength of the wellbore tubular, workover operations such as retrieving the wellbore tubular can be performed.

Implementations of the subject matter described here can offer the following potential advantages. By coating corroded length segments of the wellbore tubular and consequently improving the mechanical strength of the entire wellbore tubular, a risk of the tubular breaking during retrieval can be minimized. The assembly used to coat the inner wall of the wellbore tubular can be operated using the existing well intervention technique. Consequently, a number of trips into and out of the well can be optimized. The techniques described here enable coating an entire wall of the wellbore tubular along a full length along a longitudinal axis of the wellbore tubular. The techniques also enable coating only one or more specific length segments of the wellbore tubular, each identified as having corroded.

Figure 1A:
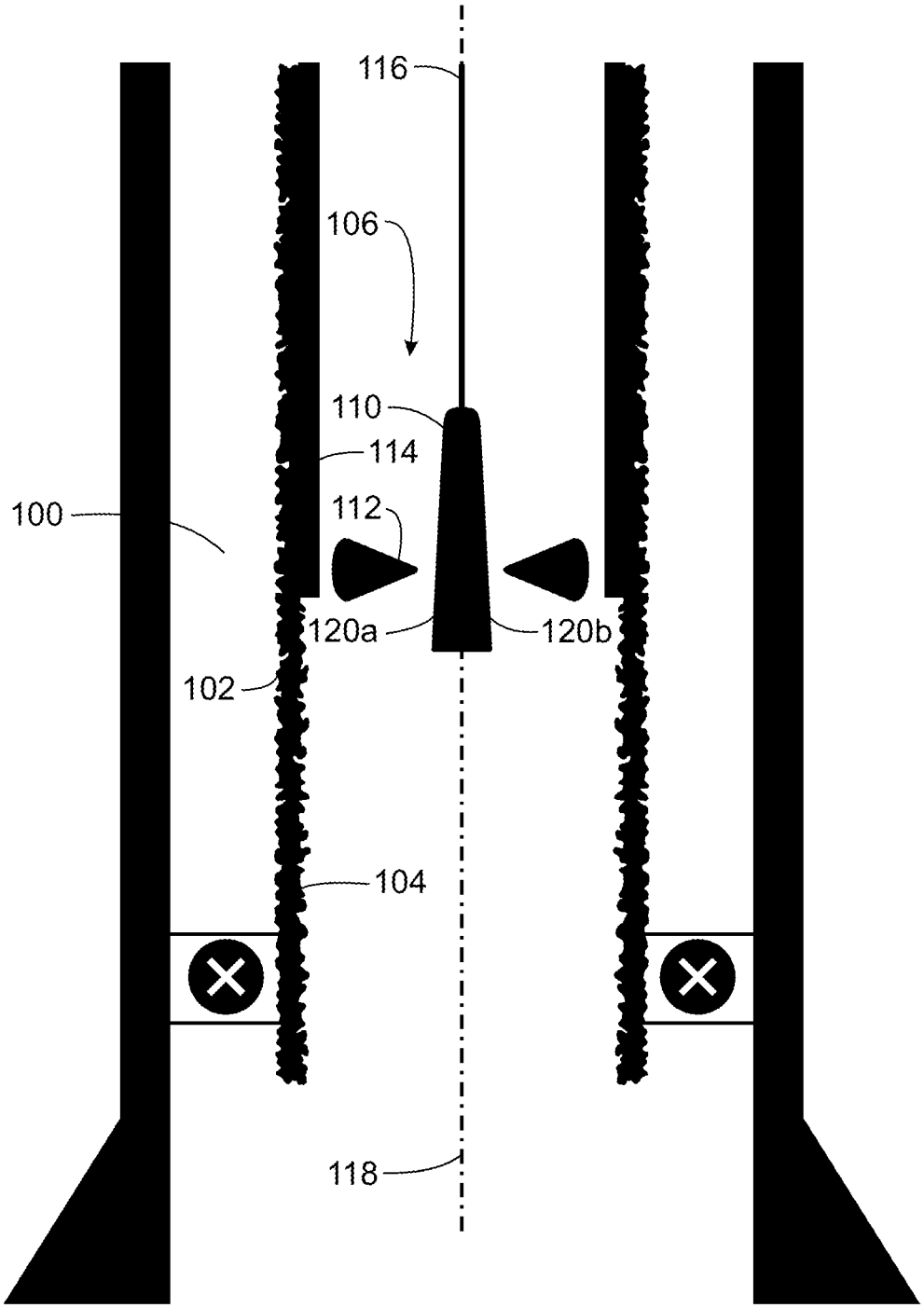
FIGS. 1A and 1B are schematic diagrams showing workover operations within a wellbore.
Figure 1B:
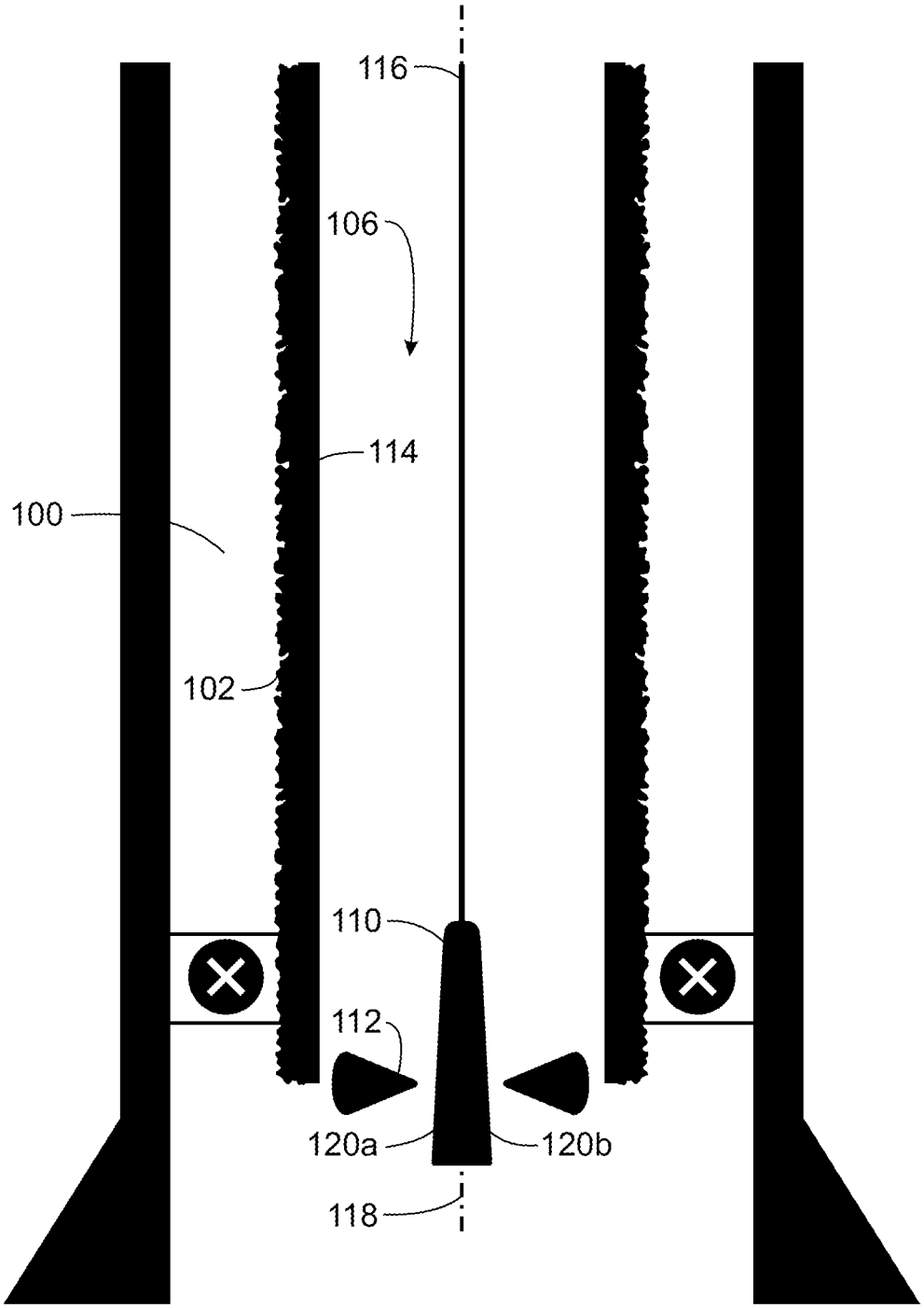

FIGS. 1A and 1B are schematic diagrams showing workover operations within a wellbore 100. The wellbore 100 is formed from a surface (not shown) of the Earth through a subterranean zone (e.g., a formation, a portion of a formation, multiple formations) to a subsurface reservoir in which hydrocarbons are entrapped. A wellbore tubular 102 is installed within the wellbore 100. For example, the wellbore tubular 102 can be a production tubing that is hung from a Christmas tree tubing hanger (not shown). The wellbore tubular 100 can extend from the surface of the wellbore through the subterranean zone to the subsurface reservoir. Hydrocarbons are produced from the subsurface reservoir to the surface through the wellbore tubular 102. In some implementations, other well fluids (e.g., water) can also be flowed through the wellbore tubular 102. Due to the corrosive nature of the well fluids, the wellbore tubular 102 can have degraded over time. The degradation of the wellbore tubular 102 (e.g., corrosion, loss of material or similar change in wellbore tubular 102 that negatively impacts mechanical strength of the wellbore tubular 102) is schematically shown in FIG. 1A by frayed edges 104 or cuts along an inner wall of the wellbore tubular 102.

As described earlier, workover operations that involve engaging the wellbore tubular 102 (e.g., removal of the wellbore tubular 102) can be impacted by the degradation of the wellbore tubular 102. For example, when attempting to retrieve the wellbore tubular 102 from within the wellbore 100, the degradation can cause the wellbore tubular 102 to break leaving a portion of the wellbore tubular 102 within the wellbore 102. To prevent such an occurrence, a wellbore workover tool assembly 106 is lowered into the wellbore tubular 102. As described below, the wellbore workover tool assembly 106 can coat a composition on an inner wall of the wellbore tubular 102 to increase a mechanical strength of the wellbore tubular 102 and to generally counter the effects of degradation.

The wellbore workover tool assembly 106 includes a coating sub-assembly 110 that can be lowered through the wellbore tubular 102. The coating sub-assembly 110 can carry a composition 112. For example, the coating sub-assembly 110 can include a housing and a container within the housing. The composition can be stored in the container and have fluidic components (e.g., pipes, valves, flow controllers, etc.) using which the composition can be flowed from the container to regions outside the housing. The coating sub-assembly 110 can be controlled from the surface of the wellbore. Alternatively or in addition, the coating sub-assembly 110 can be controlled from within the wellbore.

In some implementations, as an alternative to or in addition to carrying the composition in the container, the composition can be delivered to downhole locations within the wellbore tubular 102 through a wellbore conveyance such as a coiled tubing or a drill pipe. In such implementations, the composition can be stored at or near the surface and can be pumped (using pumping equipment) through the wellbore conveyance to desired locations within the wellbore tubular 102. In such deployment, the composition can be continuously pumped for an extended duration instead of or in addition to being pumped only when wellbore tubular degradation needs to be addressed.

The coating sub-assembly 110 can coat the composition 112 on an inner wall 104 of the wellbore tubular 102. The composition 112 can increase a mechanical strength of the wellbore tubular 102. For example, the coating sub-assembly 110 can apply a coat 114 of the composition 112 along the inner wall of the wellbore tubular 102. The coat 114 of the composition 112 can fill the frayed edges 104 or cuts with the composition 112. The added material can increase the mechanical strength of the wellbore tubular 102 and counter any degradation. A quantity of the composition 112 coated on the inner wall of the wellbore tubular 112 can be determined based on factors including a level of degradation and an inner diameter of the wellbore tubular 102. In particular, the quantity can be selected to avoid the coat causing flow blockages or undesirable increase in backpressure.

The wellbore workover tool assembly 106 includes a wellbore conveyance 116 that can be operatively coupled to the coating sub-assembly 110. In some implementations, the wellbore conveyance 116 (e.g., a coiled tubing, a drill pipe, an electric cable such as an e-line) can lower and raise the coating sub-assembly 110 through the wellbore 100 as the coating sub-assembly 110 coats the composition 112 on the inner wall of the wellbore tubular 102 to form the coat 114. In some implementations, the wellbore conveyance 116 can be deployed with no string attached. For example, the wellbore conveyance 116 can be deployed as a downhole drone that carries the coating sub-assembly 110 into and out of the wellbore 100 without the use of a string.

In some implementations, instead of or in addition to carrying the composition 112 in the coating sub-assembly 110, the composition 112 can be flowed to the coating sub-assembly 110 from the surface of the wellbore 100 through the wellbore conveyance 116. In such implementations, the wellbore conveyance 116 can flow the composition 112 through the coating sub-assembly 110 when the coating sub-assembly 110 reaches an appropriate depth within the wellbore tubular 102.

As shown in FIG. 1A, the wellbore conveyance 116 lowers the coating sub-assembly 110 in a downhole direction along a longitudinal axis 118 of the wellbore tubular 102. In some implementations, the coating sub-assembly 110 is a spray coating sub-assembly, which includes multiple nozzles (e.g., nozzles 120*a*, 120*b*) that spray the composition 112 on the inner wall of the wellbore tubular 102. The nozzles 120*a*, 120*b* can be oriented radially with reference to the longitudinal axis 118 of the wellbore tubular 102. The direction of orientation of the nozzles 120*a*, 120*b* can be changed from the radial orientation to be oriented at an uphole or downhole angle. As the wellbore conveyance 116 lowers the coating sub-assembly 110, the coating sub-assembly 110 can spray the composition 112 on the inner wall of the wellbore tubular 102. A speed at which the coating sub-assembly 110 is lowered through the wellbore tubular 102 can depend, in part, on a quantity of the composition 112 to be coated on the inner wall of the wellbore tubular 102. For example, at lower speeds of lowering the coating sub-assembly 110 through the wellbore tubular 102, a thicker coat of the composition 112 can be applied on the inner wall.

In some implementations, a determination can be made that certain length segments of the wellbore tubular 102 need a thicker coat of the composition 112 compared to other length segments. For example, a first length segment can have corroded more than a second length segment. The difference in corrosion can be determined by corrosion sensors. In such implementations, the speed at which the coating sub-assembly 110 is lowered through the wellbore tubular 102 can be varied. For example, the speed can be lower past the more corroded, first length segment compared to the less corroded, second length segment. In this manner, the thickness of the coat of the composition 112 can be varied based on a level of corrosion on the length segment of the wellbore tubular 102. In implementations in which a length segment has not been corroded, the coating sub-assembly 110 can be operated to not apply the composition 112 on the length segment.

In some implementations, the coating sub-assembly 110 can be lowered and raised through the wellbore tubular 102 multiple times to coat the inner wall of the wellbore tubular 102 multiple times. The number of times and a thickness of each coating can be modified based, for example, on a degradation in the wellbore tubular 102. In some implementations, the same composition can be coated multiple times on the inner wall of the wellbore tubular 102. In some implementations, different compositions can be coated, for example, as layers over each other. In such implementations, different compositions can be carried in different containers in the coating sub-assembly 110.

FIG. 1B shows the well conveyance 116 having lowered the coating sub-assembly 110 to or downhole of the downhole end of the wellbore tubular 102. Subsequently, the well conveyance 116 can be operated to raise the coating sub-assembly 110 out of the wellbore tubular 102. In some implementations, the coating of the composition 116 can be performed as the coating sub-assembly 110 is being raised from the downhole end of the wellbore tubular 102 to the surface. In some implementations, the coating of the composition 116 can be performed both when the coating sub-assembly 110 is lowered and when the coating sub-assembly 110 is raised.

Figure 2:
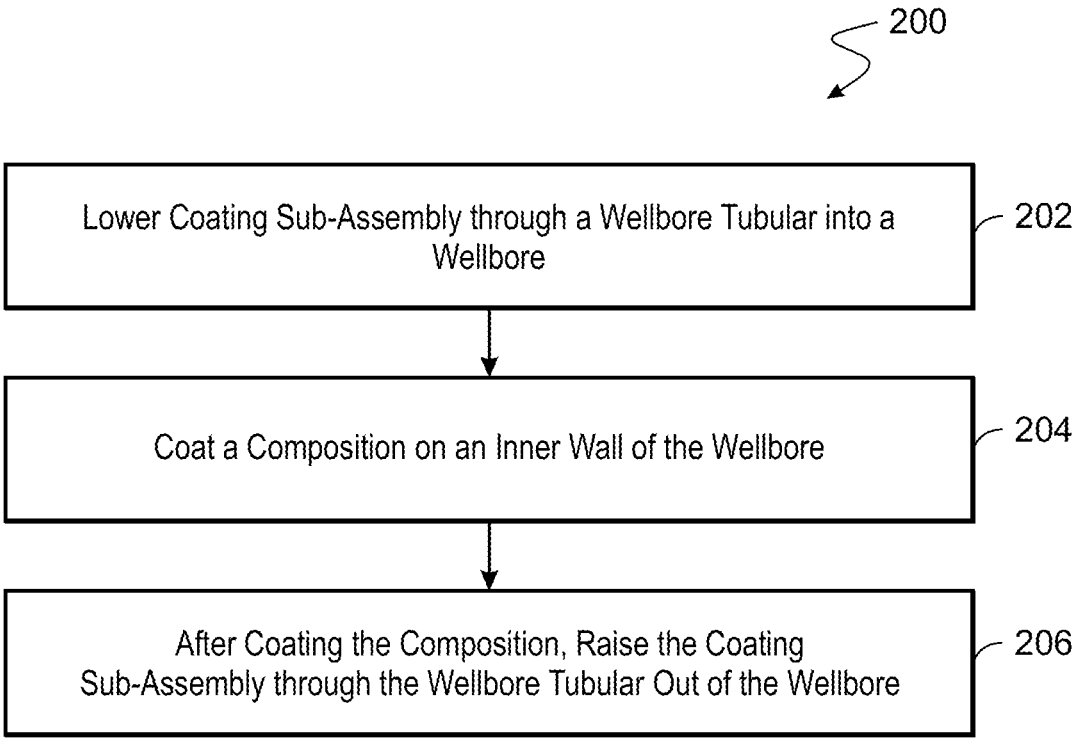
FIG. 2 is a flowchart of an example of a process of coating a wellbore tubular installed within a wellbore.

FIG. 2 is a flowchart of an example of a process 200 of coating a wellbore tubular (e.g., the wellbore tubular 102 of FIGS. 1A, 1B) installed within a wellbore (e.g., the wellbore 100 of FIGS. 1A, 1B). The process 200 can be performed during a wellbore workover operation, e.g., an operation to remove the wellbore tubular 102 installed within the wellbore 100. Alternatively or in addition, the process 200 can be performed during the regular operation of the wellbore 100, e.g., to extend the working life of the wellbore tubular 102.

At 202, a coating sub-assembly (e.g., the coating sub-assembly 110 of FIGS. 1A, 1B) is lowered using a wellbore conveyance (e.g., the wellbore conveyance 116 of FIGS. 1A, 1B) through the wellbore tubular 102 into the wellbore 100. For example, the wellbore conveyance can be controlled using equipment installed at a surface of the wellbore.

At 204, a composition carried by the coating sub-assembly is coated on an inner wall of the wellbore using the coating sub-assembly. As described earlier with reference to FIGS. 1A, 1B, the composition can increase a mechanical strength of the wellbore tubular. The composition can cure upon contact with the inner wall of the wellbore. Prior to coating, the composition can be in a liquid state. After curing, the composition can transition to a solid state. Prior to coating, i.e., prior to being in the liquid state, the composition can originally be in a solid state. Prior to coating, the composition can be heated to transition from the solid state to the liquid state. To perform the coating, the composition can be sprayed on to the inner wall of the wellbore. To do so, the composition can be flowed through multiple nozzles (e.g., nozzles 120*a*, 120*b* of FIGS. 1A, 1B) that spray the composition on the inner wall of the wellbore tubular.

At 206, after coating the composition on the inner wall of the wellbore, the coating sub-assembly can be raised through the wellbore tubular out of the wellbore using the wellbore conveyance. As described earlier, the coating sub-assembly can coat the composition on the inner wall either during the downhole trip (i.e., process step 202) or during the uphole trip (i.e., process step 206) or during both trips. After coating the composition on the inner wall, the process can wait a duration sufficient for the composition to cure on the inner wall of the wellbore tubular. For example, after the duration has expired, the composition in the liquid state can have transitioned to the solid state, thereby increasing the mechanical strength of the wellbore tubular. Subsequently, the wellbore tubular with the increased mechanical strength can be retrieved from within the wellbore.

Figure 3:
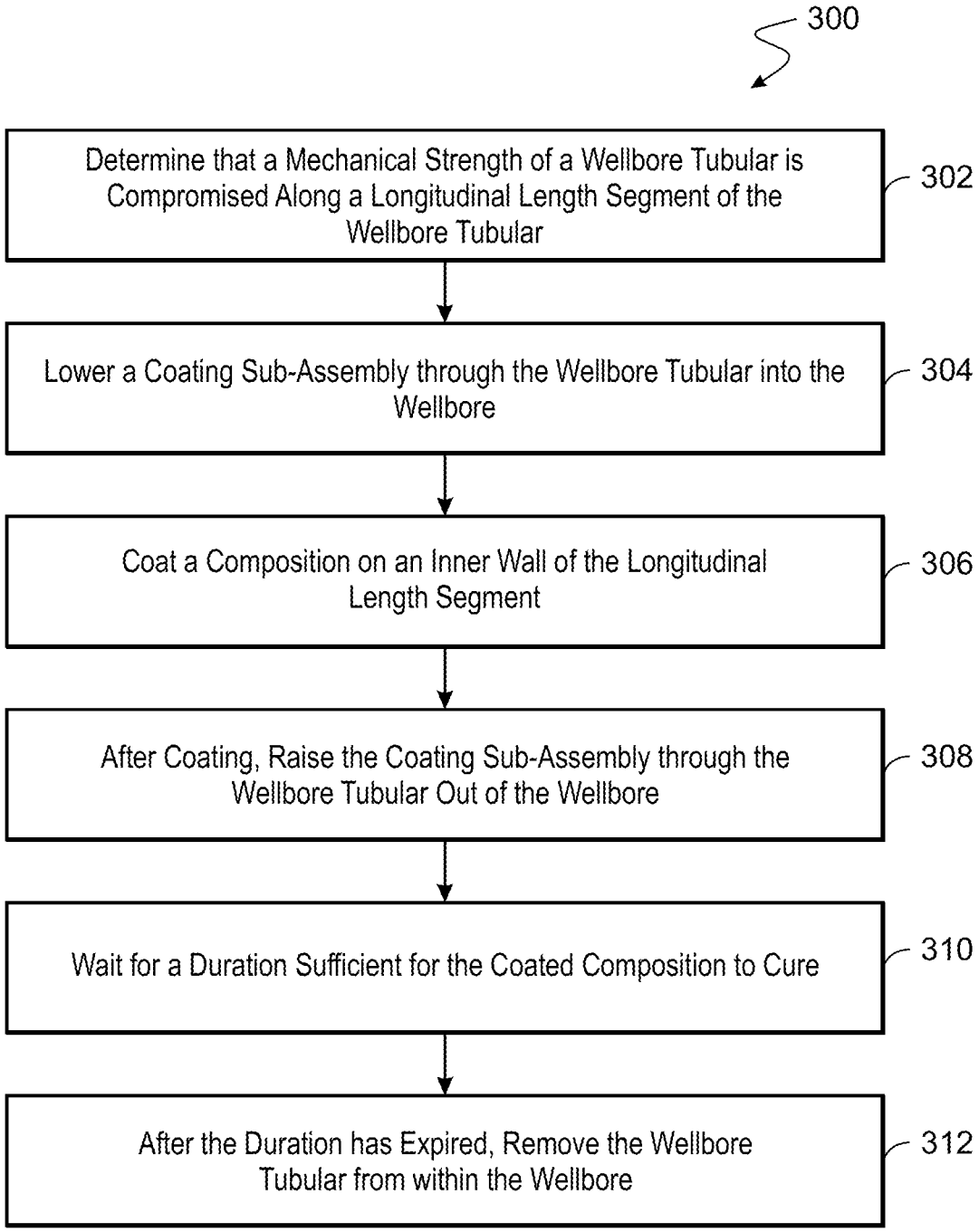
FIG. 3 is a flowchart of an example of a process of coating a wellbore tubular installed within a wellbore as part of a wellbore workover operation.

FIG. 3 is a flowchart of an example of a process 300 of coating a wellbore tubular (e.g., the wellbore tubular 102 of FIGS. 1A, 1B) installed within a wellbore (e.g., the wellbore 100 of FIGS. 1A, 1B) as part of a wellbore workover operation (e.g., a wellbore decompletion operation). At 302, it can be determined that a mechanical strength of a wellbore tubular installed within a wellbore is compromised along a longitudinal length segment of the wellbore tubular. The longitudinal length segment can represent an entire length or a portion of a length of the wellbore tubular along its longitudinal axis. In some implementations, the determination can be made using the well age, degradation properties of the material with which the wellbore tubular is made and corrosive nature of fluids (e.g., sourness of gas) that flow through the wellbore tubular. In some implementations, the determination can be made based on an appearance of cracks/cuts on the wellbore tubular 102 during workover operations to extract the wellbore tubular 102 from within the well 100.

At 304 and in response to determining that the mechanical strength is compromised, a coating sub-assembly is lowered through the wellbore tubular into the wellbore using a wellbore conveyance. At 306 and using the coating sub-assembly, a composition carried by the coating sub-assembly is coated on an inner wall of the longitudinal length segment. The composition can increase a mechanical strength (e.g., tensile strength) of the longitudinal length segment. At 308, after coating the composition on the inner wall of the wellbore, the coating sub-assembly is raised through the wellbore tubular out of the wellbore using the wellbore conveyance. At 310, a duration sufficient for the coated composition to cure on the longitudinal length segment of the wellbore is allowed to pass. At 312, after the duration has expired, the wellbore tubular is removed from within the wellbore.

Thus, particular implementations of the subject matter have been described. Other implementations are within the scope of the following claims.

The invention claimed is:

1. A method comprising:

during a wellbore workover operation to remove a wellbore tubular installed within a wellbore:

lowering, using a wellbore conveyance, a coating sub-assembly through the wellbore tubular into the wellbore;

coating, using the coating sub-assembly, a composition carried by the coating sub-assembly on an inner wall of the wellbore, wherein the composition comprises epoxy or resin or a combination thereof and is configured to increase a mechanical strength of the wellbore tubular, wherein coating the composition comprises spray coating the composition on the inner wall of the wellbore tubular;

after coating the composition on the inner wall of the wellbore, raising, using the wellbore conveyance, the coating sub-assembly through the wellbore tubular out of the wellbore; and after coating the composition on the inner wall of the wellbore tubular, removing the wellbore tubular with the coated composition from within the wellbore.

2. The method of claim 1, wherein the composition is configured to cure upon contact with the inner wall of the wellbore tubular, wherein the method further comprises, after coating the composition on the inner wall of the wellbore and before removing the wellbore tubular with the coated composition, waiting for a duration sufficient for the composition to cure on the inner wall of the wellbore tubular.

3. The method of claim 2, wherein, prior to coating, the composition is in a liquid state, and after curing, the composition transitions to a solid state, wherein waiting for the duration comprises waiting for the duration sufficient for the composition to transition from the liquid state to the solid state.

4. The method of claim 3, wherein, prior to coating, the composition is in a solid state, wherein the method further comprises, prior to coating, heating the composition to transition from the solid state to the liquid state.

5. The method of claim 1, wherein spray coating the composition comprises flowing the composition through a plurality of nozzles that sprays the composition on the inner wall of the wellbore tubular.

6. The method of claim 5, further comprising orienting the plurality of nozzles radially with reference to a longitudinal axis of the wellbore tubular.

7. The method of claim 1, further comprising varying a speed at which the coating sub-assembly is lowered through the wellbore tubular into the wellbore based on a quantity of the composition to be coated on the inner wall of the wellbore.

8. A method comprising:

determining that a mechanical strength of a wellbore tubular installed within a wellbore is compromised along a longitudinal length segment of the wellbore tubular;

in response to determining that the mechanical strength is compromised;

lowering, using a wellbore conveyance, a coating sub-assembly through the wellbore tubular into the wellbore;

coating, using the coating sub-assembly, a composition carried by the coating sub-assembly on an inner wall of the longitudinal length segment, wherein the composition comprises epoxy or resin or a combination thereof and is configured to increase a mechanical strength of the longitudinal length segment, wherein coating the composition comprises spray coating the composition on the inner wall of the wellbore tubular;

after coating the composition on the inner wall of the wellbore, raising, using the wellbore conveyance, the coating sub-assembly through the wellbore tubular out of the wellbore;

waiting for a duration sufficient for the coated composition to cure on the longitudinal length segment of the wellbore tubular; and after the duration has expired, removing the wellbore tubular from within the wellbore.

9. The method of claim 8, further comprising varying a speed at which the coating sub-assembly is lowered through the wellbore tubular into the wellbore based on a quantity of the composition to be coated on the inner wall of the longitudinal length segment.

10. The method of claim 9, further comprising:

determining that the longitudinal length segment needs a thicker coat of the composition compared to a different longitudinal length segment of the wellbore tubular; and in response to determining that the longitudinal length segment needs a thicker coat of the composition compared to a different longitudinal length segment of the wellbore tubular, lowering the coating sub-assembly at a lower speed past the longitudinal length segment that needs the thicker coat compared to the different longitudinal length segment.

* * * * *